United States Patent [19]

Sakurai et al.

[11] 4,292,258

[45] Sep. 29, 1981

[54] ALTITUDE COMPENSATING DEVICE FOR CARBURETORS

[75] Inventors: Shoichiro Sakurai, Hitachi; Tadahiko Otani, Katsuta, both of Japan

[73] Assignee: Hitachi, Ltd., Tokyo, Japan

[21] Appl. No.: 114,391

[22] Filed: Jan. 22, 1980

[30] Foreign Application Priority Data

Jan. 26, 1979 [JP] Japan ..... 54/7174

[51] Int. Cl.[3] ..... F02M 7/24

[52] U.S. Cl. ..... 261/39 A; 261/121 B

[58] Field of Search ..... 261/39 A, 121 B

[56] References Cited

U.S. PATENT DOCUMENTS

| | | | |
|---|---|---|---|
| 2,389,219 | 11/1945 | Thompson et al. | 261/39 A |
| 3,810,606 | 5/1974 | Masaki | 261/121 B |
| 3,831,910 | 8/1974 | Schadbolt | 261/39 A |
| 3,925,521 | 12/1975 | Otani | 261/121 B |
| 3,931,372 | 1/1976 | Pierlut | 261/121 B |
| 4,129,622 | 12/1978 | Tamazawa et al. | 261/121 B |
| 4,153,652 | 5/1979 | Ogita | 261/39 A |
| 4,177,224 | 12/1979 | Yamanaka et al. | 261/121 B |

FOREIGN PATENT DOCUMENTS

| | | | |
|---|---|---|---|
| 52-9728 | 1/1977 | Japan | 261/121 B |

*Primary Examiner*—Tim R. Miles

*Attorney, Agent, or Firm*—Craig and Antonelli

[57] ABSTRACT

An altitude compensating device for carburetors has an air metering valve in fluid communication with the fuel passage of the carburetor and a pressure-sensitive bellows adapted to drivingly control the air metering valve such that the flow rate of the compensating air is increased as the altitude increases. A closed control air chamber is defined at the upstream side of the air metering valve. Venturi vacuum around the venturi portion of the intake passage of the carburetor and air are introduced into the control air chamber so that the pressure in the latter is reduced below the atmospheric pressure with an increase of the intake air flow rate to the engine and the compensating air is decreased to eliminate undesirable low concentration tendency of the mixture.

8 Claims, 3 Drawing Figures

ALTITUDE COMPENSATING DEVICE FOR CARBURETORS

The present invention relates to an altitude compensating device for carburetors and, more particularly, to an altitude compensating device capable of supplying an adequate amount of compensating air during operation at altitudes.

BACKGROUND OF THE INVENTION

Generally, it is well known that a richer air-fuel mixture is supplied by a carburetor when automobiles run at altitudes than that obtained during operation at sea level.

It is also known that the concentration or air-fuel ratio of the air-fuel mixture is determined by amounts of air and fuel supplied to the engine. The fuel content of the air-fuel mixture is adjusted by means of an amount of fuel flowing through a fuel jet and an amount of air supplied from an air bleed. It is therefore possible to finally determine an air-fuel ratio of the mixture by controlling the flow rate of air flowing through the air bleed. It is naturally understood that an undesirable high concentration tendency at altitudes is effectively avoided by increasing the flow rate of bleed air in accordance with the increase of the altitude.

As a practical measure for such a control of bleed air, it has been proposed to drive by a bellows sensitive to the atmospheric pressure an air metering valve which in turn meters the air supplied to the main well of the carburetor thereby to make the mixture lean. This system is described in detail in the specification of the U.S. Pat. No. 4,129,622.

When an automobile provided with a carburetor incorporating this type of altitude compensating device runs at altitudes, the air-fuel mixture is inconveniently made lean as the flow rate of the intake air is increased, so that the engine fails to provide the required output power, resulting in a deteriorated driving performance.

This undesirable leaning of the air-fuel mixture is considered to be attributable to the following reason. Namely, as the flow rate of the intake air is increased, the venturi vacuum generated at the venturi of the carburetor is increased to cause a large differential pressure between the venturi vacuum and the atmospheric pressure at the upstream side of the air metering valve constituting an altitude compensating device, so that an excessively large amount of air is allowed to flow into the main well of the carburetor.

In order to avoid this undesirable phenomenon, it has been attempted to design and adjust an altitude compensating device of which altitude compensating characteristics match the state of large flow rate of intake air. This, however, results in an excessively rich mixture when the flow rate of intake air is comparatively small.

SUMMARY OF THE INVENTION

It is, therefore, an object of the invention to provide an altitude compensating device for carburetors, capable of supplying an adequate amount of altitude compensating air to the carburetor irrespective of the operating condition of the engine.

To this end, according to the invention, the pressure at the upstream side of the air metering valve for altitude compensation, which valve is in fluid communication with the fuel delivery passage of the carburetor, is lowered down to the level below the atmospheric pressure in accordance with the increase of the flow rate of the intake air, thereby to reduce the flow rate of compensating air in response to the increase of the intake air flow rate.

DESCRIPTION OF THE PREFERRED EMBODIMENTS

Figure 1:
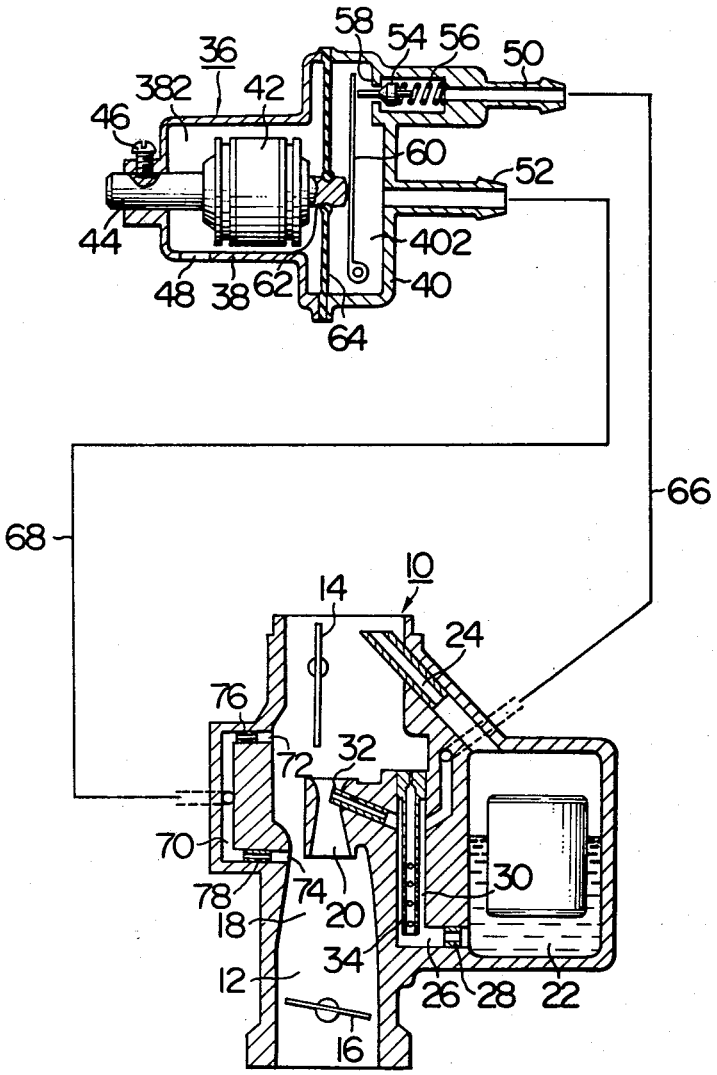
FIG. 1 shows in section an altitude compensating device for carburetors according to an embodiment of the invention.

The invention will be more fully understood from the following description of the preferred embodiments with reference to the accompanying drawings.

Referring to the drawings, a reference numeral 10 designates a carburetor body having an intake passage 12 formed therein. A choke valve 14 and a throttle valve 16 are rotatably disposed in the intake passage 12. A large venturi 18 and a small venturi 20 are disposed in the intake passage 12 between the choke valve 14 and the throttle valve 16. The carburetor body 10 is provided with a float chamber 22 which is filled with fuel. The free space at the upper part of the float chamber 22 is in communication with the portion of the intake passage 12 upstream from the choke valve 14 through an air vent 24. A fuel passage 26 provides a communication between the float chamber 22 and the small venturi 20. A calibrated fuel jet 28, main well 30 and nozzle 32 are disposed at an intermediate portion of the fuel passage 26. Also, an air-bleed tube 34 is disposed in the main well 30. The major constituents of the carburetor mentioned above are all known and, therefore, the detailed description of these constituents is considered not necessary.

An altitude compensating device of the invention is generally designated by reference numeral 36. Major parts of this device are accommodated within a pair of casings 38, 40. A bellows 42 sensitive to the change in altitude is disposed in an atmospheric chamber 382 which is defined by the casing 38. The bellows 42 is fixed to the casing 38 through the medium of a shaft 44 by means of a screw 46. An atmospheric air port 48 for introducing the atmospheric air into the atmospheric chamber 382 is formed in the casing 38.

On the other hand, a first nipple 50 and a second nipple 52 are attached to the casing 40 to be in communication with the interior of the casing 40.

An air metering valve 54 is disposed in the passage formed in the nipple 50 and is biased in one direction by means of a spring 56 to meter the air in cooperation with a valve seat 58 formed on the casing 40. A swingable lever 60 is installed in a control air chamber 402 defined by the casing 40 to magnify and transmit the displacement of a movable shaft 62 of the bellows 42 to the air metering valve 54. Interposed between the pair of casings 38, 40 is a partition or diaphragm 64 which divides the space defined by the casings into two chambers in an airtight manner. The diaphragm 64 is fixed to the movable shaft 62. The altitude compensating device 36 according to this embodiment is connected to the carburetor 10 in a manner described below. The first nipple 50 is communicated with the main well 30 through an air conduit 66, while the second nippple 52 is communicated with an air take-out passage 70 through an air conduit 68. The air take-out passage 70 is opened to the large venturi 18 as at an opening 72 and to the upstream side of the large venturi 18 at its other end as at an opening 74. Orifices 76 and 78 are provided near the openings in the air take-out passage 70. The aforementioned air conduit 68 branches off from the air take-out passage 70 between the orifices 76, 78.

Hereinafter, a description will be made as to the operation of the altitude compensating device of the invention. The altitude compensating device 36 does not operate during the engine operation substantially at sea level, so that the carburetor operates in the same manner as the ordinary carburetor having no altitude compensating device.

When the automobile runs at a altitude of, for example, 1500 m above the sea level, the bellows 42 is deflected by an amount dependent on the altitude. This deflection of the bellows 42 is transmitted through the movable shaft 62 and lever 60 to the air metering valve 54, so that the air metering valve 54 cooperates with the valve seat 58 to acquire and maintain a predetermined area of passage for air.

The engine is then started with the choke valve 14 closed. A comparatively high vacuum is applied to the openings 72, 74 due to the closing of the choke valve 14. This high vacuum is then communicated to the control air chamber 402 in the casing 40 via the orifices 76, 78, the air take-out passage 70 and the air conduit 68. Since the pressure difference between the pressure in the control air chamber 402 and the pressure acting on the nozzle 32 is very small in this state, little or no flow of air occurs from the conduit 66 to the main well 30, so that the mixture produced by the carburetor is sufficiently rich for starting the engine.

As the engine is started and warmed up, the choke valve 14 is fully opened to permit the engine to operate in ordinary condition. In this state, the pressure about the large venturi 18 becomes closer to the atmospheric pressure than at the time of starting of the engine. Meanwhile, the pressure substantially equal to the atmospheric pressure is maintained at the upstream side of the large venturi 18. Accordingly, the vacuum produced at the opening 74 is materially neutralized by the air supplied through the opening 72, so that the pressure in the air take-out passage 70 is maintained substantially at the atmospheric pressure. The air in the air take-out passage 70 is therefore induced into the control air chamber 402 through the air conduit 68 to increase the pressure in the control chamber 402 substantially to the atmospheric pressure. Meanwhile, the main well 30 is subjected to the vacuum generated in the small venturi 20. Therefore, the air in the control air chamber 402 is delivered to the main well 30 through the air metering valve 54 and the air conduit 66, thereby to provide an altitude compensation. This altitude compensating operation is identical to that performed by ordinary altitude compensating devices.

As the throttle valve 16 is opened to a larger opening degree to increase an amount of air supplied to the engine, the vacuum in the large venturi 18 is increased correspondingly. This increased vacuum is then transmitted to the air take-out passage 70 through the orifice 78 and the opening 74. Although air is introduced into the air take-out passage 70 through the orifice 76 from the opening 72 upstream of the large venturi 18, it is not possible to maintain the atmospheric pressure in the air take-out passage 70 by the air from the opening 72 because the vacuum generated in the large venturi 18 is so high. As a result, the pressure in the air take-out passage 70 becomes lower than the atmospheric pressure to be transmitted to the control air chamber through the air conduit 68. Thus the pressure differential between the control air chamber 402 and the main well 30 is reduced when the intake air flow rate is large, so that the flow rate of air flowing from the control air chamber 402 to the main well 30 is reduced to prevent undesirable excessive leaning of the mixture during engine operation at a high intake air flow rate. It is to be noted that the pressure established in the control air chamber 402 can be varied as desired by suitably selecting the diameters of the orifices 76, 78.

Figure 2:
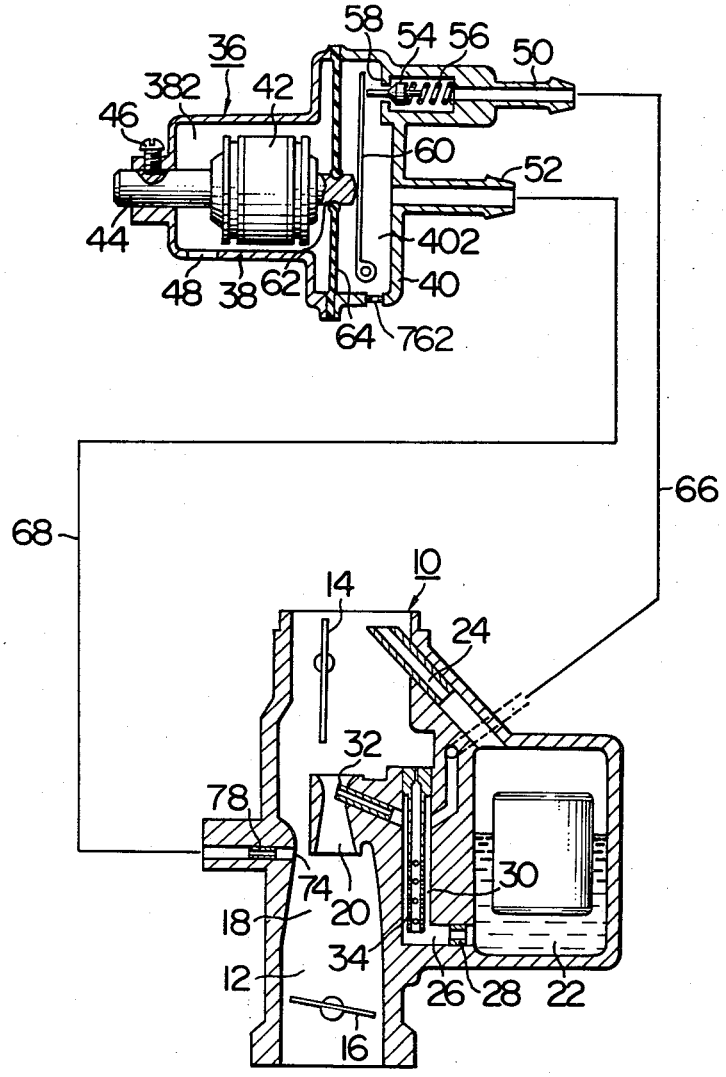
FIG. 2 shows in section an altitude compensating device for carburetors according to another embodiment of the invention.

FIG. 2 shows an altitude compensating device constructed in accordance with a second embodiment of the invention, in which the same reference numerals designate the same parts or members as those of the first embodiment. The altitude compensating device shown in FIG. 2 is different from that of FIG. 1 in that the opening 72 is not influenced by the choke valve 14. In FIG. 2, the air conduit 68 is communicated only with the large venturi 18 through the orifice 78. On the other hand, the casing 40 defining the control air chamber 402 therein is provided with an orifice 762 which is opened to the atmosphere. This orifice 762 corresponds to the opening 72 and the orifice 76 shown in FIG. 1.

This altitude compensating device of the second embodiment in FIG. 2 operates substantially in the same manner as the first embodiment shown in FIG. 1, except that the orifice 762 is not influenced by the choke valve 14 during the starting and warming up of the engine. Namely, the orifice 762 opened to the atmosphere offers an advantage in that the matching of the altitude compensating characteristic is easy to attain. The reason for this is that the pressure in the control air chamber 402 can be adjusted simply by adjusting the vacuum in the large venturi 18 through an adjustment of the orifice 78 since the orifice 762 is always exposed to the atmospheric pressure. Alternatively, the adjustment of the pressure in the control air chamber 402 may be attained if the orifice 78 is a fixed one and the orifice 762 is replaceable or variable. All that is required is to vary one of the pressures while fixing the other pressure as the reference pressure.

In the second embodiment as described above, the orifice 762 opened to the atmosphere is formed in the casing 40 of the altitude compensating device 36. However, this is not exclusive and the orifice 762 may be provided at the upstream side of the choke valve 14.

A third embodiment of the invention will be described hereinunder with reference to FIG. 3, in which the same reference numerals designate the same parts or members as those of the first embodiment shown in FIG. 1. This third embodiment in FIG. 3 is characterized in that the pressure in the control air chamber 402 is not influenced by the deflection of the bellows 42.

Figure 3:
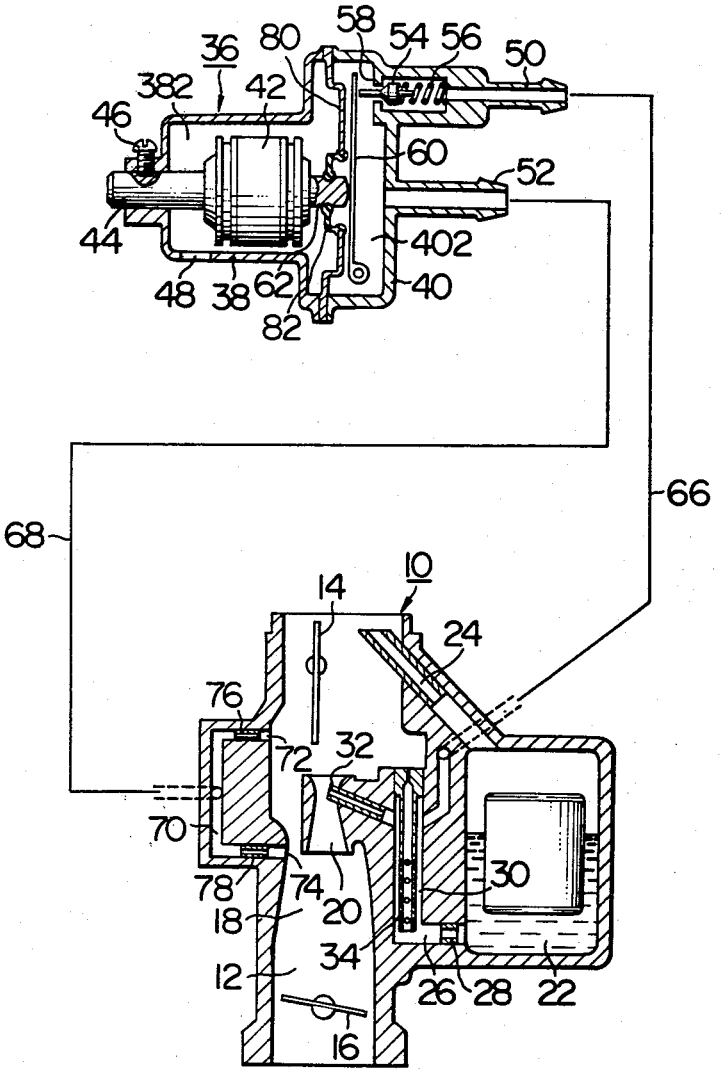
FIG. 3 shows in section an altitude compensating device for carburetors according to still another embodiment of the invention.

More specifically, referring to FIG. 3, a metallic partition plate 80 is clamped between the casings 38, 40, the inner periphery of which is extended as closely as possible to the movable shaft 62. The inner periphery of the partition plate 80 is connected to the movable shaft 62 through the bellowphragm 82 made of rubber, so that the casings 38, 40 are separated from each other in an airtight manner by means of the partition plate 80 and the bellowphragm 82.

In operation, when the engine is started, warmed up or operated at a large intake air flow rate, the pressure in the control air chamber 402 can be reduced below the atmospheric pressure, and the force due to the pressure differential between the atmospheric chamber 382 and the control air chamber 402 is exerted on the movable shaft 62 through the action of the bellowphragm 82. This force, however, is very small because the bellowphragm 82 has only a small effective pressure receiving area. Therefore, the shaft 62 fixed to the bellows 42 can impart to the lever 60 a displacement precisely dependent on the change in the altitude.

It will be clear to those skilled in the art that the altitude compensating device of the third embodiment can operate substantially in the same manner as that of the first embodiment in FIG. 1.

As will be apparent from the foregoing description, according to the invention, the pressure at the upstream side of the air metering valve constituting the altitude compensating device is lowered dependent on the increase of the intake air flow rate supplied to the engine. Therefore, the aforementioned undesirable high concentration tendency of the mixture, which is inevitable produced in the carburetors having conventional altitude compensating device as the intake air flow rate is increased, can fairly be avoided.

What is claimed is:

1. An altitude compensating device for carburetors comprising:

(a) a partition plate disposed between first and second casings and for airtightly separating said casings from each other;

(b) a pressure-sensitive element disposed in a first chamber defined by said first casing and said partition plate, and an atmospheric air port formed in the wall of said first casing;

(c) an air metering valve disposed in a second chamber defined by said second casing and said partition plate and adapted to be driven by said pressure-sensitive element so as to have its metering area increased with the decrease of the atmospheric pressure;

(d) a first passage for communicating the downstream side of said air metering valve with a fuel passage through which fuel is delivered to the intake passage of said carburetor;

(e) a second passage for communicating said second chamber with a venturi portion formed between a choke valve and a throttle valve disposed in said intake passage; and (f) a third passage adapted to supply air to said second chamber at least after the full opening of said choke valve.

2. An altitude compensating device for carburetors as claimed in claim 1, wherein each of said second and third passages are provided at their respective intermediate portions with orifices.

3. An altitude compensating device for carburetors as claimed in claim 1, wherein said partition plate is a diaphragm which is clamped between said first and second casings and fixed to a movable shaft secured to said pressure-sensitive element.

4. An altitude compensating device for carburetors as claimed in claim 1, wherein said partition plate comprises a metallic plate clamped between said first and second casings and extended radially inwardly near to the movable shaft connected to said pressure-sensitive element and a bellowphragm connected at its radially outer and inner peripheries to said metallic plate and said movable shaft, respectively.

5. An altitude compensating device for carburetors as claimed in claim 1, wherein said third passage is a passage through which said second chamber is communicated with the space defined by said choke valve and said venturi portion.

6. An altitude compensating device for carburetors as claimed in claim 1, wherein said third passage is a passage through which said second chamber is directly communicated with the atmosphere.

7. An altitude compensating device for carburetors as claimed in claim 1, wherein said third passage is an aperture which is formed in said second casing and provided therein with an orifice.

8. An altitude compensating device for carburetors comprising:

(a) a fuel passage through which fuel is delivered to an intake passage of said carburetor;

(b) a first passage communicated with said fuel passage to deliver compensating air thereto;

(c) an air metering valve disposed at an intermediate portion of said first passage;

(d) a closed air chamber disposed upstream of and communicated with said air metering valve;

(e) a second passage provided separate from said first passage and communicating said air chamber with a venturi portion formed in said intake passage;

(f) a third passage for communicating said air chamber with the atmosphere; and (g) a pressure-sensitive element provided outside of said air chamber exclusively in communication with atmospheric pressure and shiftable in response to a change in the atmospheric pressure to drivingly control said air metering valve in a manner causing the flow rate of the compensating air delivered through said first passage to be increased with an increase in altitude.

* * * * *